United States Patent [19]

Barron

[11] Patent Number: 4,623,205

[45] Date of Patent: Nov. 18, 1986

[54] BONDING FLANGE ADAPTER

[76] Inventor: Earl L. Barron, P.O. Box 10356, Houston, Tex. 77206

[21] Appl. No.: 433,157

[22] Filed: Dec. 2, 1982

[51] Int. Cl.[4] ..... H01R 4/66

[52] U.S. Cl. ..... 339/14 L; 339/15; 339/272 R

[58] Field of Search ..... 339/14 L, 14 R, 15, 339/263 L, 272 R

[56] References Cited

U.S. PATENT DOCUMENTS

| | | | |
|---|---|---|---|
| 2,710,381 | 6/1955 | Monson | 339/14 L |
| 3,492,625 | 1/1970 | Bromberg | 339/14 R |
| 3,706,959 | 12/1972 | Norden | 339/14 R |
| 3,832,672 | 8/1974 | Loos | 339/14 L X |
| 3,967,872 | 7/1976 | Mooney et al. | 339/14 L |
| 4,189,198 | 2/1980 | Reichman | 339/14 L X |
| 4,210,374 | 7/1980 | Churla | 339/14 L |
| 4,312,551 | 1/1982 | Mascolo et al. | 339/15 X |

*Primary Examiner*—Gil Weidenfeld
*Assistant Examiner*—Steven C. Bishop
*Attorney, Agent, or Firm*—Neal J. Mosely

[57] ABSTRACT

A bonding flange adapter is disclosed which provides an efficient and quick device for attaching bonding ribbon to sleeves or splicing casings used in connection with cable in the telecommunications, i.e. television, telephone, telegraph, etc., field. Telecommunications cable is usually encased in tubing or casing for protection in installation. The cable casing is usually pressurized with gas and is grounded by metal ribbon secured to the casing and to ground. This bonding flange adapter provides both a means for attaching the grounding ribbon and a means for introducing air into the casing or for measuring air pressure, in the form of a fitting which is threaded into a sleeve or splicing case and has a threaded opening for an air valve and a slotted connection for a grounding ribbon.

4 Claims, 5 Drawing Figures

BONDING FLANGE ADAPTER

BACKGROUND OF THE INVENTION

1. Field of the Invention

This invention relates to new and useful improvements in electrical connectors and more particularly to a fitting or connector for grounding telecommunications cable and for pressuring the cable with air or gas.

2. Brief Description of the Prior Art

In the telecommunications industry, cable is usually provided with protective casing or tubing and joints are made through the use of sleeves or splicing cases.

In the past, telecommunications cable has been grounded by metal ribbon which was either screwed on the casing sleeve or splicing case or soldered thereon. In either case the connection was awkward, required an excessive amount of work, and did not provide for pressurizing the cable with air or gas.

Loos U.S. Pat. No. 3,832,672 discloses a grounding coupling for electrical wire raceways.

Churla U.S. Pat. No. 4,210,374 discloses a set-screw bushing with an integral electrical clamp.

Reichman U.S. Pat. No. 4,189,198 discloses a conduit ground wire coupling.

Mooney U.S. Pat. No. 3,967,872 discloses a cradle-type ground lug for conduits.

Monson U.S. Pat. No. 2,710,381 discloses a grounding coupling for junction boxes.

None of these patents discloses a grounding or bonding adapter constructed for threaded connection to a cable casing or sleeve or splicing case with an air valve connection for introduction or air pressure or measurement of air pressure in the cable.

SUMMARY OF THE INVENTION

One of the objects of this invention is to provide a new and improved bonding flange adapter for use in the telecommunications industry.

Another object of this invention is to provide a bonding flange adapter for use in the telecommunications industry which is easy to build and use.

Another object of this invention is to provide a bonding flange adapter for use in the telecommunications industry which provides an easy connection of bonding ribbon to a sleeve or splicing case.

Another object of this invention is to provide a bonding flange adapter for use in the telecommunications industry which provides an easy connection of bonding ribbon to a sleeve or splicing case and a connection for pressurizing cable with air or for measuring air pressure therein.

Other objects of this invention will become apparent from time to time throughout the specification and claims as hereinafter related.

These and other objects of the invention are accomplished by a bonding flange adapter disclosed which provides an efficient and quick device for attaching bonding ribbon to sleeves or splicing casings used in connection with cable in the telecommunications, i.e. television, telephone, telegraph, etc., field. This bonding flange adapter provides both a means for attaching the grounding ribbon and a means for introducing air into the casing or for measuring air pressure, in the form of a fitting which is threaded into a sleeve or splicing case and has a threaded opening for an air valve and a slotted connection for a grounding ribbon.

BRIEF DESCRIPTION OF THE DRAWINGS

FIG. 1 is a view in central section of a conventional bonding flange used in the telecommunications industry for securing an air valve to cable casing or splicing sleeves or cases or the like.

DESCRIPTION OF THE PREFERRED EMBODIMENT

Figure 1:
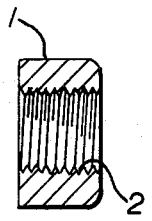
Figure 2:
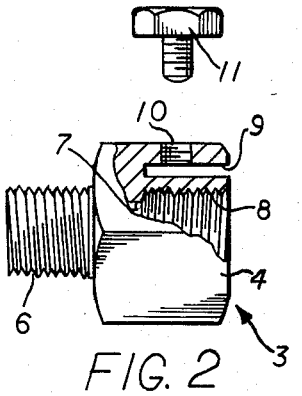
FIG. 2 is a view, partially in section, of a bonding flange adapter illustrating a preferred embodiment of this invention.
Figure 3:
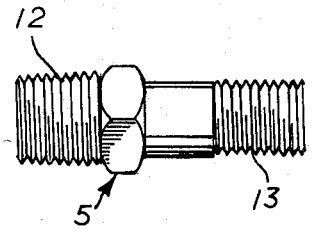
FIG. 3 is a view in elevation of an air valve shown in exploded relation to the adapter of FIG. 2 for use therewith.

Referring to the drawings by numerals of reference, there is shown, in FIG. 1, a bonding flange 1 of the type used for installing air valves on telecommunications cables or for introducing air for pressurizing such cable. Bonding flange 1 has an internally threaded opening 2 for receiving the bonding flange adapted as subsequently described.

Bonding flange adapter 3 comprises an adapter body 4 and valve member 5. Adapter body 4 has a threaded tubular extension 6 and an internal passage 7 therethrough. Adapter body 4 has passage 7 enlarged and internally threaded as at 8 at the opposite end for connection to air valve body 5.

Adapter body 4 has a wide slot 9 at one side with a threaded opening 10 through the wall thereof for receiving a clamping screw 11. The slot 9 and clamping screw 11 provide for securing a metal bonding or grounding ribbon in place.

Air valve body 5 has externally threaded tubular projecting portions 12 and 13 at opposite ends. Threaded portion 12 is received in threaded opening in adapter body 4 and threaded portion 13 is adapted to be connected to an air line for introduction of air pressure or to a gauge for measuring air pressure in the cable casing.

Figure 4:
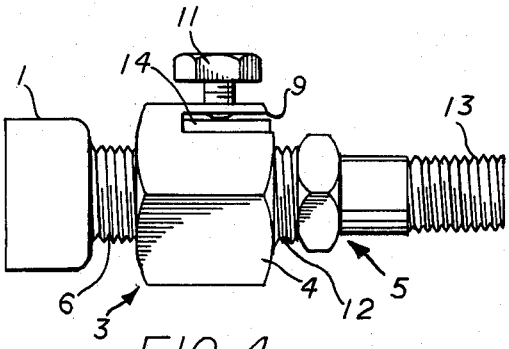
FIG. 4 is a view in elevation of the bonding flange, adapter and air valve in assembled relation with a metal grounding ribbon installed in place.
Figure 5:
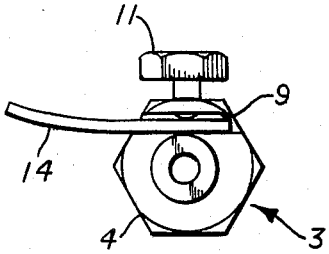
FIG. 5 is an end view of the bonding flange adapter.

In FIGS. 4 and 5, the apparatus is shown in a fully assembled relation. Bonding flange 1 is normally a part of or secured on a cable casing or sleeve or splicing case or the like. Adapter body 4 has threaded tubular extension 6 threadedly secured in threaded opening 2. Passage 7 is open throughout its length for introduction of air into the cable casing or for measurement of the air pressure therein. Air valve 5 has threaded portion 12 threadedly secured in threaded opening 8 in adapter body 4.

A bonding or grounding ribbon 14 is positioned in slot 9 and clamped tightly in place by clamping screw 11. All components of the bonding flange adapter are metal and provide efficient electrical conduction for grounding the cable with which the adapter is used. This provides a simple arrangement for removably securing the bonding ribbon in place. The assembly provides an easier connection for the bonding ribbon and simultaneously provides a connection for introducing air pressure into the cable casing or for measuring the air pressure therein.

I claim:

1. In combination a bonding flange for a telecommunications cable, sleeve, or splicing case, having a female threaded opening, an adapter comprising a tubular metal body having a male threaded tubular extension threadedly connected in said threaded opening, an internal passage, and an enlarged passage portion having internal female threads adapted to receive a threaded connector of an air valve for introducing compressed air into or measuring air pressure in the telecommunications cable, said metal adapter body having a longitudinally extending slot substantially parallel to a longitudinal axis thereof and of a size sufficient to receive a metal bonding ribbon for bonding or grounding the telecommunications cable, sleeve, or splicing case on which said adapter is secured, and a clamping screw extending from an outer surface of said body into said slot for clamping a metal bonding ribbon in place.

2. A combination according to claim 1 including an air valve, for introducing compressed air into or measuring the air pressure in the telecommunications cable, comprising a valve body having externally threaded tubular projecting portions at opposite ends, one of said threaded portions being threadedly received in said threaded adapter body opening, and said other threaded portion being adapted to be connected to an air line for introduction of air pressure or to a gauge for measuring air pressure in the cable casing.

3. An adapter for bonding flanges for telecommunications cable, sleeve, or splicing case, having a female threaded opening, said adapter comprising a tubular metal body having a male threaded tubular extension adapted to be threadedly connected in said threaded opening, an internal passage, and an enlarged passage portion having internal female threads adapted to receive a threaded connector of an air valve for introducing compressed air into or measuring air pressure in the telecommunications cable, said metal adapter body having a longitudinally extending slot substantially parallel to a longitudinal axis thereof and of a size sufficient to receive a metal bonding ribbon for bonding or grounding the telecommunications cable, sleeve, or splicing case on which said adapter is secured, and a clamping screw extending from an outer surface of said body into said slot for clamping a metal bonding ribbon in place.

4. An adapter according to claim 3 including an air valve, for introducing compressed air into or measuring the air pressure in the telecommunications cable in which the adapter is to be received, comprising a valve body having externally threaded tubular projecting portions at opposite ends, one of said threaded portions being threadedly received in said threaded adapter body opening, and said other threaded portion being adapted to be connected to an air line for introduction of air pressure or to a gauge for measuring air pressure in the cable casing.

* * * * *